US007511209B1

(12) United States Patent
Liao

(10) Patent No.: US 7,511,209 B1
(45) Date of Patent: Mar. 31, 2009

(54) STRUCTURE OF BASE DRUM COUNTER-HOOP MOUNTED CLAMP

(76) Inventor: Chi-Ching Liao, No. 2, Lane 86, Cung Chu Rd., Pei Tun District, Taipei City (TW)

( * ) Notice: Subject to any disclaimer, the term of this patent is extended or adjusted under 35 U.S.C. 154(b) by 0 days.

(21) Appl. No.: 12/124,173

(22) Filed: May 21, 2008

(51) Int. Cl.
*G10D 13/02* (2006.01)

(52) U.S. Cl. ..... 84/411 R

(58) Field of Classification Search ..... 84/411 R, 84/421, 413, 415
See application file for complete search history.

(56) References Cited

U.S. PATENT DOCUMENTS

2007/0193432 A1* 8/2007 Dunnett ..... 84/411 R
2008/0041215 A1* 2/2008 Wang ..... 84/411 R

* cited by examiner

*Primary Examiner*—Kimberly R Lockett
(74) *Attorney, Agent, or Firm*—Leong C. Lei

(57) ABSTRACT

A structure of a base drum counter-hoop mounted clamp is provided for attaching a small-sized music instrument to a counter hoop of a base drum. A clamp body is shaped to have upper and lower locking platforms that are substantially parallel and connected by a vertical plate, which has a side surface from which a pivot seat projects to pivotally couple a connection member. Opposite ends of the connection member are respectively coupled to a V-shaped clip body and a threaded bolt bar. With the threaded bolt bar being tightened and driven downward, the clip body is upward pushed against and secured to the counter hoop of the base drum. A holder formed atop the upper platform receives and fixes a support bar that supports an additional music instrument thereto.

5 Claims, 3 Drawing Sheets

STRUCTURE OF BASE DRUM COUNTER-HOOP MOUNTED CLAMP

BACKGROUND OF THE INVENTION (a) Technical Field of the Invention

The present invention relates to an improved structure of a base drum counter-hoop mounted clamp, which comprises a clamp body having upper and lower locking platforms coupled to a counter hoop of the base drum and a vertical plate arranged therebetween forming centrally an opening and a projecting pivot seat to accommodate insertion and coupling of a movable connection member, the connection member having an end to which a V-shaped clip block is pivoted to oppose to a clip plate mounted to an underside of the upper platform for respectively clamping against opposite surfaces of the counter hoop and an opposite end to which a threaded bolt bar is rotatably coupled so that with the threaded bolt bar tightened and driven downward, the clip block pivoted to the end of the connection member is pushed upward to securely clamp and position on the counter hoop for allowing a holder formed on the upper platform to mount a support bar that carries a music instrument, whereby simple and convenient racking of the music instrument to the base drum is realized to provide a safe and practical purposes of simple assembling.

(b) Description of the Prior Art

For the need of performance, music instruments are often arranged and racked together in a set. The racking of the music instruments requires racks/stands, as shown in FIG. 6 of the attached drawings, wherein a base drum 30 is provided as a core of the racking of the music instruments. Pre-shaped rack 31 is arranged around the base drum 30 for mounting various instruments 32 for a performer to move within a limited space to play these instruments. Such a racking of the music instruments is very inconvenient in connecting and assembling of the parts thereof, and due to that all the stands or racks are independently arranged, the legs 33 are expanded and occupy quite a floor area to firmly and safely support the music instruments. This is certainly a waste of the floor space and also leads to an undesired expansion of the limited space that the performer is moving therein for playing the instruments, resulting in the inconvenience of performing percussion of the drums. In addition, the expanded legs 33 make the practical operation/movement in the stage in convenient; especially for a small stage, it would become very crowded. To make the arrangement of music instruments with a simplified configuration to make the racking space more concentrated for convenience of use, racking devices are available in the market, such as a drum-mounted clamp disclosed in U.S. Pat. No. 5,684,258, wherein a pivotally connected bar and a clamp body are arranged in a vertical direction and pivoted and a locking bar is provided for assembling purposes to mounting the clamp body to the counter hoop of the base drum. With the locking effect realized by the locking bar and a spring encompassing around the locking bar, the clamp body can be secured. However, since force applied in percussion of the instrument is variable, the resilient clamping will result in instability of the clamp body. Due to the instability of mounting of the clamp body, the music instrument supported thereby can not effect stable production of sound and satisfy the needs of racking. Thus, such a solution is not appealing to the users. In addition, the known solution uses a ringed bar to support and secure also surfaces instability of receiving and holding the instrument. This is because the straight knurled surface of an insertion ring thereof is not able to effectively hold and fix a straight bar like support rack, leading to unsafe racking. This also makes it not appealing to the users. It is thus desired to alleviate the above mentioned impracticability of the known racking structure and provide a more practical music instrument racking that features simplified assembling.

SUMMARY OF THE INVENTION

The primary purpose of the present invention is to provide an improvement of a base drum counter-hoop mounted clamp that comprises a pre-shaped clamp body having a lever like pivoting joint of a movable connection member to a vertical plate to have a clip body mounted to an end of the connection member simply clamped on the counter hoop of the base drum by means of the tightening of a threaded bolt bar on an opposite end of the connection member and a holder provided atop the clamp body to mount a support bar for racking of various music instruments so that the music instrument can be arranged in a concentrative manner around the base drum, thereby significantly improving drawbacks that the known music instrument set occupies a bulky space and is difficult to assemble.

An objective of the present invention is to provide a clamp that allows a clamp body to directly clamp to a counter hoop of a base drum for receiving the insertion of a support bar to facilitate the convenience of mounting various music instruments thereby realizing the convenience and practicability of simple positioning and assembling of music instruments in a performance.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
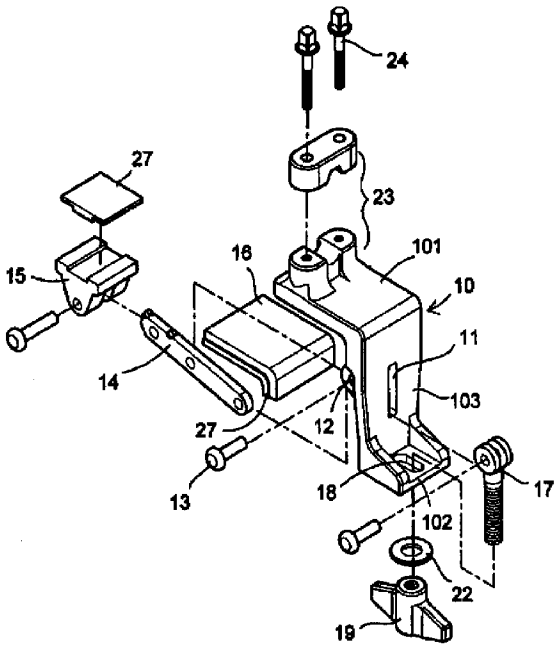
FIG. 1 is an exploded view of a base drum counter-hoop mounted clamp constructed in accordance with the present invention.
Figure 2:
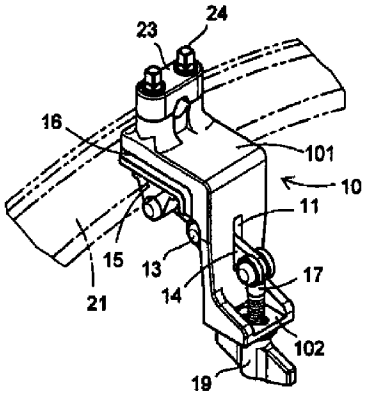
FIG. 2 is a perspective view of the base drum counter-hoop mounted clamp of the present invention attached to a counter hoop.
Figure 3:
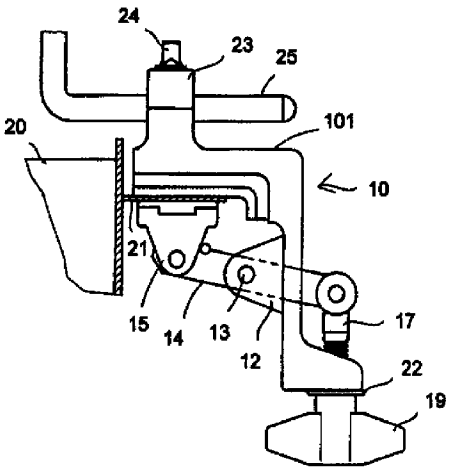
FIG. 3 is a schematic view illustrating a clamping operation of the base drum counter-hoop clamp of the present invention.
Figure 4:
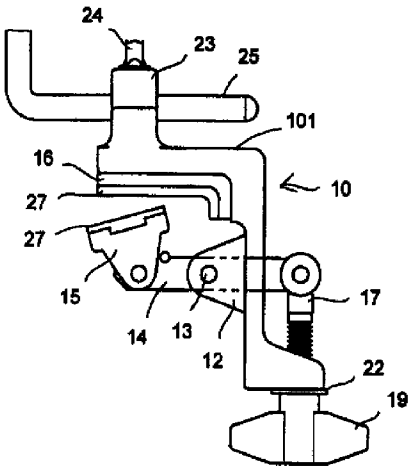
FIG. 4 is a schematic view illustrating the base drum counter-hoop mounted clamp of the present invention clamped to a counter hoop.
Figure 5:
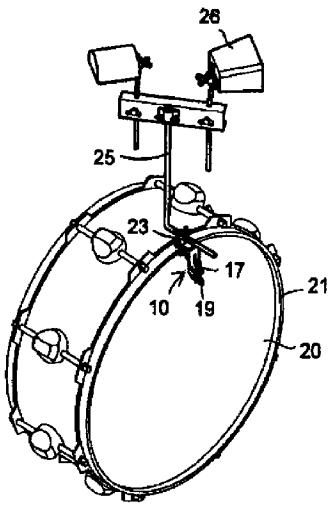
FIG. 5 is a perspective view illustrating the condition of use of the base drum counter-hoop mounted clamp of the present invention.
Figure 6:
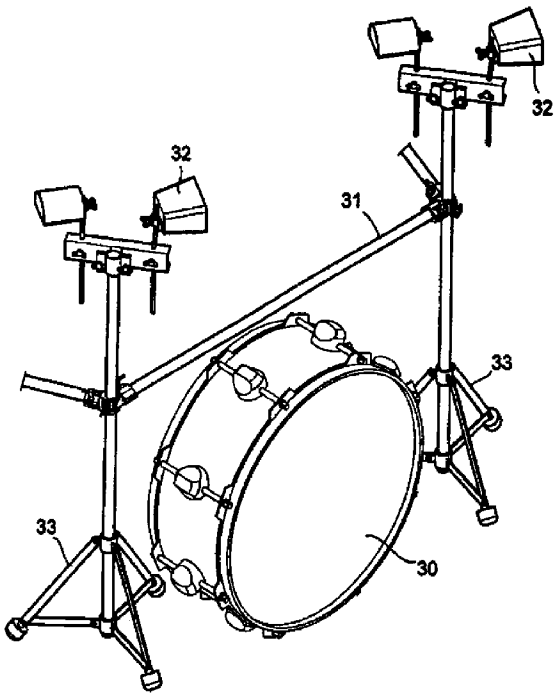
Fig. 6 PRIOR ART
FIG. 6 is a perspective view illustrating a known music instrument racking.

With reference to the drawings and in particular to FIGS. 1-5, a clamp for mounting to a counter hoop of a base drum in accordance with the present invention is provided for supporting other music instruments on a base drum, designated at 20 in FIG. 5, to form a instrument combination, in which the base drum 20 serves as a foundation for racking the instrument combination. The base drum 20 has a counter hoop 21 to which a clamp body 10 having a predetermined configuration is mounted in such a way that the clamp body 10 forms an upper platform 101 and a lower platform 102 that are substantially parallel to each other. A vertical plate 103 connects between the upper and lower platforms 101, 102. The vertical plate 103 defines, in a central portion thereof, an elongate opening 11. On one side of the vertical plate 103, in which the opening 11 is formed, a projecting pivot seat 12 is formed for rotatably mounting a pivot 13 to an intermediate section of a movable plate like connection member 14. An end of the connection member 14 is pivoted to a V-shaped clip block 15, which, together with a clip plate 16 mounted to an underside of the upper platform 101, can clip on opposite sides of the counter hoop 21. The clip plate 16 can be made of plastics and/or rubber to ensure not to damage the counter hoop 21 and secure clamping. An opposite end of the connection member 14 is coupled to a threaded bolt bar 17 for adjustment purposes. The threaded bolt bar 17 extends through an elongate hole 18 defined in the lower platform 102 and is further fit through a washer 22 and engages a nut member 19 for adjusting the overall length of locking thereof to thereby make the clip block 15 on the other end of the connection member 14 clipped against and positioned on the counter hoop 21. On the top of the upper platform 101, a holder 23 is formed. The holder 23 comprises a movable top lid that works with locking bolts 24 for effecting securing and clamping by conveniently employing a centrally recessed hole-based seat for receiving the insertion of a support bar 25 therein to realize securing and positioning thereof, thereby providing expandable racking of other music instruments or accessories. In this way, with the clamp body 10 secured to and positioned on the counter hoop 21 of the base drum 10, other small-sized music instruments 26 can be easily secured and racked to a periphery of the base drum 20 to facilitate the operation and control of percussion in performance.

To ensure the stability and convenience of the clamping operation, the movable V-shaped clip block 15 and the clip plate 16 can be selectively provided with a thin layer of resilient, soft pad or plate 27 mounted to a clamping surface thereof by means of adhesives or other known means, for firmly clamping and engaging the counter hoop 21 without causing damage to surfaces of the counter hoop 21, in order to realize secure and firm clamping and fixing. For the holder 23 arranged on the top of the upper platform 101, to ensure stable and firm securing of the support bar 25, a surface of the recessed receiving slot can be made roughened, or is provided with a resilient, thin soft pad (not shown) to achieve firm clamping result. To facilitate convenience of disassembling, when the lock bolts 24 are inserted and tightened, between the opposing securing surfaces or in the recessed slot of the holder 23, a resilient element or a resilient pad is previously provided, which facilitates to separate the two securing surfaces at the time to disassemble or replace, so that insertion/assembling or replacement of the support bar 25 is made convenient, thereby realizing convenience of practical operation for simple disassembling and replacement. In this way, arbitrary combination of various small-sized music instruments 26 can be done to facilitate the use thereof in performance with the music instruments 26 positioned at suitable location around the counter hoop of the base drum 20. Bulkiness and inconvenience that the conventional mounting rack surfers can be eliminated. The drawback of uncertainty of the locking operation that the known locking type clamp surfers can also be eliminated. Concentrative arrangement of music instruments can be realized in accordance with the present invention and racking of music instrument group can be effectively simplified.

In accordance with the present invention, the racking system is designed on the basis that the base drum 20 stably positioned on the ground. The secondary small-sized instruments or accessories are directly mounted to the counter hoop 21 of the base drum 20. By means of the adjusting threaded bolt bar 17 extending through the lower platform 102 of the clamp body 10 to simply couple an end of the connection member 14, the V-shaped clip block 15 that is pivotally connected thereto is operatively drivable to clamp against a rim of the counter hoop 21 of the base drum 20. This, together, with the soft, resilient pad 27, provides resilient and stable engagement and securing without damage to surfaces of the counter hoop 21. With the support provided to the connection member 14 by the pivot seat 12, the operation of the threaded bolt bar 17 on one end leads to the abutting and clamping engagement of a lever type realized in the other end, whereby the clamp body 10 can be firmly clamped to and positioned on the counter hoop 21 of the base drum 20. With the easy insertion and coupling of the instrument support bar 25 realized by the holder 23, the position where some of the small-sized music instruments 26 are mounted can be simply adjusted to make use and operation of the instruments 26 easy in the performance. Thus, the present invention is of practicable convenience and practical economics for being easy to manufacture with low costs and is thus fully satisfied with the current need of concentrative arrangement of various music instruments. It is concluded that the present invention is a brand new and simple and convenient design for clamping and positioning of music instruments.

To summarize, the structure of base drum counter-hoop clamp in accordance with the present invention uses a pre-shaped clamp body, together with a lever type securing/releasing control and adjustment for clamping, to make the clamp body firmly and stably clamped on counter hoop of a base drum for properly positioning. The top portion of the clamp body secures, in a simple way, a support rack for safely mounting various music instruments on the counter hoop of the base drum in a concentrative arrangement. Thus, space for arranging and racking music instrument is effectively reduced and practical convenience is realized.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A base drum counter-hoop mounted clamp, adapted to clamp a support bar for mounting an additional music instrument to a base drum, comprising a clamp body comprising a vertical plate having opposite ends to which an upper platform and a lower platform are respectively connected, wherein the upper platform is provided with and supports a holder to mount the support bar for mounting the additional music instrument, the upper platform having an underside to which a clip plate is mounted, wherein the vertical plate forms centrally an elongate opening through which a movable connection member is received, a projecting pivot seat formed on one side of the vertical plate for pivotally coupling the connection member, the connection member having an end to which a V-shaped clip block is mounted and opposing the clip plate and an opposite end to which a threaded bolt bar is rotatably mounted, the threaded bolt bar extending through the lower platform and engaging a nut member, whereby the clip block of the connection member and the clip plate of the clamp body are selectively clamped onto opposite surfaces of a counter hoop of the base drum for fixing, and wherein the nut member tightens on the threaded bolt bar to adjust a locking length of the threaded bolt bar, resulting in a lever type abutting operation to have the clamp body directly fixed to and positioned on the counter hoop, whereby with the support bar inserted and coupled to the holder, the additional music instrument is mounted to a suitable location around the counter hoop of the base drum for facilitating performance thereof.

2. The base drum counter-hoop mounted clamp as claimed in claim 1, wherein the clip plate mounted to the underside of the upper platform is made of plastics/rubber material.

3. The base drum counter-hoop mounted clamp as claimed in claim 1, wherein the holder has a securing surface to which a resilient pad or plate is mounted.

4. The base drum counter-hoop mounted clamp as claimed in claim 1, wherein the threaded bolt bar is first fit through a washer and then engages the nut member.

5. The base drum counter-hoop mounted clamp as claimed in claim 1, wherein the holder forms a recessed receiving slot that has a roughened surface or is provided with a resilient soft pad.

* * * * *